US006751870B2

(12) United States Patent
Tapia

(10) Patent No.: US 6,751,870 B2
(45) Date of Patent: Jun. 22, 2004

(54) HAIRCUTTING INSTRUMENT AND METHOD OF USE

(76) Inventor: Chris Tapia, 486 Old Newport Blvd., Newport Beach, CA (US) 92663

( * ) Notice: Subject to any disclaimer, the term of this patent is extended or adjusted under 35 U.S.C. 154(b) by 61 days.

(21) Appl. No.: 10/080,138

(22) Filed: Feb. 22, 2002

(65) Prior Publication Data

US 2003/0159295 A1 Aug. 28, 2003

(51) Int. Cl.[7] ..... B26B 13/00
(52) U.S. Cl. ..... 30/191; 30/254; 30/259
(58) Field of Search ..... 30/186, 187, 195, 30/197, 176, 177, 175, 193, 191, 244, 226, 248, 245, 233

(56) References Cited

U.S. PATENT DOCUMENTS

| | | | | |
|---|---|---|---|---|
| 34,368 A | | 2/1862 | Hurd | |
| 176,553 A | | 4/1876 | Schafer | |
| 224,148 A | * | 2/1880 | Charles | 30/233 |
| 362,817 A | | 5/1887 | Carson | |
| 496,584 A | | 5/1893 | Taft | |
| 942,356 A | | 12/1909 | Shelley | |
| 3,866,610 A | | 2/1975 | Kletschka | 128/322 |
| 3,921,641 A | | 11/1975 | Hulka | 128/321 |
| 5,153,997 A | | 10/1992 | Chiavaras et al. | 30/257 |
| 6,019,021 A | | 2/2000 | Keyvani | 81/416 |

FOREIGN PATENT DOCUMENTS

| | | |
|---|---|---|
| DE | 522418 | 3/1931 |

* cited by examiner

*Primary Examiner*—Douglas D. Watts
(74) *Attorney, Agent, or Firm*—Richard L. Myers; Myers Dawes Andras & Sherman, LLP

(57) ABSTRACT

An instrument for cutting hair comprises first and second members extending longitudinally in a direction generally parallel to a hinge axis 19 of a hinge that connects the two members. Each member has an arm and a leg. The legs have sockets in which tools are received. The arms comprise grip portions for grasping and actuating by a user's hand. During use, the actuation of the arms moves the legs in an arcuate path of a common circle about the hinge axis 19. The legs and the tools disposed in the sockets of the legs have straight features that remain parallel to each other and to the axis 19 of the hinge during movement along the arcuate path. The instrument has a closed pinching or clamping position in which the tools meet each other in abutting relation. The method of using the instrument includes selecting tools from the group comprising razor blades, thinning blades and back guards, disposing selected tools in the sockets of respective legs, separating the legs, placing a lock of hair between the legs, clamping the tools on the lock of hair, and pulling or pushing the tool in a direction along the length of the hair to progressively cut hairs of the lock of hair.

21 Claims, 5 Drawing Sheets

FIG. 7
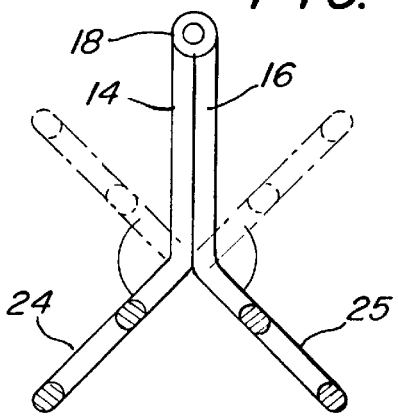
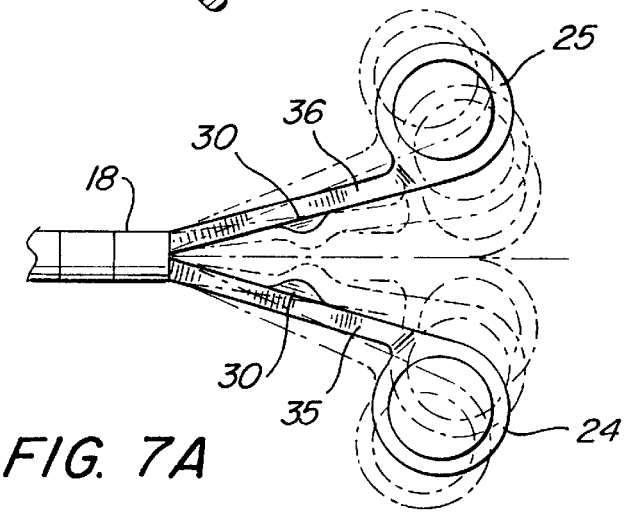
FIG. 7A
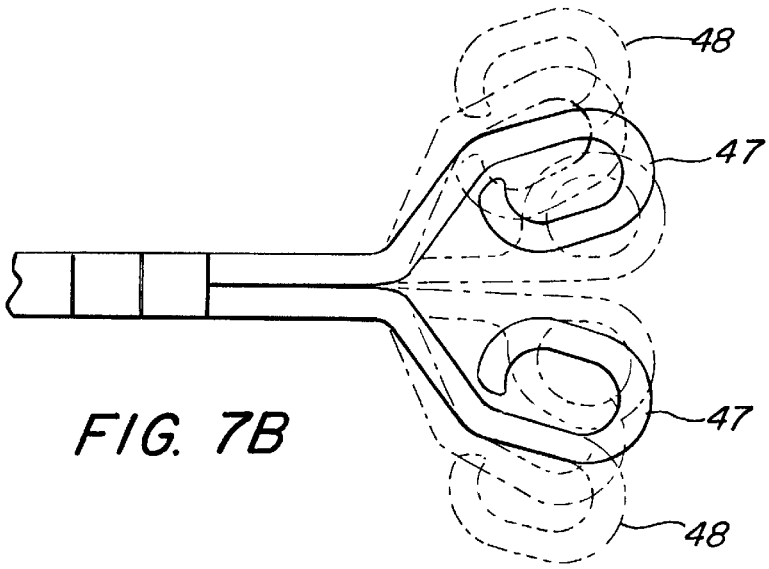
FIG. 7B

HAIRCUTTING INSTRUMENT AND METHOD OF USE

BACKGROUND OF THE INVENTION

1. Field of the Invention

The invention relates to haircutting instruments and methods of using the same primarily in barbershops and beauty salons.

2. Description of the Related Art

It is well known to use a straight blade in cutting and thinning hair. In the past this has been accomplished by placing an instrument with a blade on one side of a lock of hair and the user's finger on the opposite side of the lock of hair. The user thus pinches or clamps the lock of hair between the blade and his or her finger. This is a tedious operation and requires great skill to prevent cutting one's finger with the blade. The user must take care to avoid being cut while maintaining the proper amount of pressure and the proper angle of the blade with respect to the individual hairs in the lock of hair.

This procedure of pinching or clamping a lock of hair between the finger and a blade has the advantage of slicing the individual hairs at an acute angle which provides a softer feel at the hair ends and also inhibits the problem of the hair breaking. Another benefit of cutting the hair ends in this way is that it causes each individual hairs to lie more nicely within the lock of hair.

It can be seen that there is a need in the art for a device and a method that assures the safety of the user and provides a consistency in the angle of cut. There is a further need to provide an instrument and a method for cutting hair with a straight blade that is easy to use. Still further, there is a need to provide the above stated needs with an instrument that has easily replaceable tools including blades.

BRIEF SUMMARY OF THE INVENTION

The instant invention overcomes these deficiencies with an instrument that is easy to use, safe, and provides consistency in the angle of the cut.

The instrument is comprised of two pieces or members that are coupled by a hinge having an axis. Each piece has an arm and a leg that are substantially parallel to each other and the axis of the hinge. The arm has grip portions and the leg has sockets for receiving tools. This allows the user to actuate the legs by manipulating the grip portions of the arms.

In use, the leg portions are separated by manipulating the grip portions. A lock of hair is placed between the tools that are positioned in sockets of the legs. The legs are then clamped onto the lock of hair by a gripping action and the instrument is pulled or pushed in a direction along the length of the lock of hair. This pulling or pushing action cuts individual hairs of the lock in the progressive manner as the instrument is moved away from the person's head.

The legs have jaws that are substantially parallel to each other. The jaws in a fully clamped position are spaced apart to enable a lock of hair to slide between them. The jaws of the legs have sockets which receive tools. The tools comprise at least one cutting blade which can be a razor blade, a knife or a thinning tool. Tools also may include one back guard. Thus, the hair is clamped between two blades or a blade and a back guard so that when the instrument is pulled or pushed in a direction away from the person's head, the hairs of a lock of hair clamped between the jaws are pinched by the tools and progressively cut as the instrument is moved away from the person's head. The edges of the tools that engage the lock of hair are parallel to each other so that the lock of hair receives even pressure along the length of the tools.

In one aspect of the invention, the arms and legs of each member of the instrument are spaced radially with respect to the axis of the hinge. In another aspect the arms and legs are generally parallel to the axis of the hinge. Expressed another way, each arm and each leg extends along a line parallel to the hinge axis. With this construction, the arms and legs remain generally parallel to each other and to the hinge axis during the hinging action.

The tools may be two razor blades which meet in a parallel fashion at their distal edges. Alternatively, the tools may be two thinning blades which have teeth. These teeth meet each other similarly to the two blades. However, with the thinning blades there are spaces between the teeth through which individual hairs may pass as the instrument is pulled or pushed away from the person's head. Thus, only some of the hairs are cut. Another alternative is to have one razor blade in the socket of one of the legs, and a back guard in the socket of the other leg. In this way the back guard and the razor blade meet in a pinching manner on the lock of hair. In practice, any combination of tools may be used in the instrument as long as one of the tools comprises a blade.

In another aspect of the invention, the instrument may be constructed such that the arms of the instrument are spaced at any preferred distance of comfort to the user. This spacing may be provided by the structure of the arms adjacent to the hinge wherein the arms abut each other and thereby space the finger loops from each other at a comfortable distance. Alternatively, stops may be provided at any location on the arms to mutually abut each other and provide the desired spacing.

As with a regular pair of scissors, the grip portion of the present invention may be provided by finger loops that lie generally in a common plane. However, it is contemplated that the grip portions may be angled to that regular plane by plus or minus 70 degrees about the hinge axis. The selection of these angles can be especially important because of the different manner in which this instrument is used as compared with regular scissors. That is, the forces required when pulling or pushing the instrument along the lock of hair are different from the forces required when using a regular pair of scissors. The forces required with the instant invention, in turn, affect the gripping requirements. Because of the gripping requirements of the instant invention, having finger loop angles different from those of regular scissor finger loops is desirable in at least some cases.

In use, a lock of hair may be placed between the tools in the instrument legs and the legs may be clamped onto the lock of a hair with light pressure. Depending on the angle of the tools, little or no pressure may be required to continue the cutting action along the length of the lock of hair, cutting the hair is effected by pushing or pulling the instrument away from the person's head. The user may selectively apply more pressure to cut the individual hairs more rapidly or completely sever a lock of hair. Also a user may grasp the lock of hair between the instrument and the person's head to minimize pulling on the hair at the scalp during the use of the instrument.

These and other features and advantages of the invention will become apparent with the following description of the preferred embodiments and reference to the associate drawings.

BRIEF DESCRIPTION OF THE DRAWINGS

FIG. 7 is a cross section view taken along lines VII—VII of FIG. 2;

FIG. 7A is a detailed top view of portion VIIa shown in FIG. 3;

FIG. 7B is a top view similar to FIG. 7A showing alternative embodiments of the finger loops of FIG. 7A;

DETAILED DESCRIPTION OF THE PREFERRED EMBODIMENTS

Figure 1:
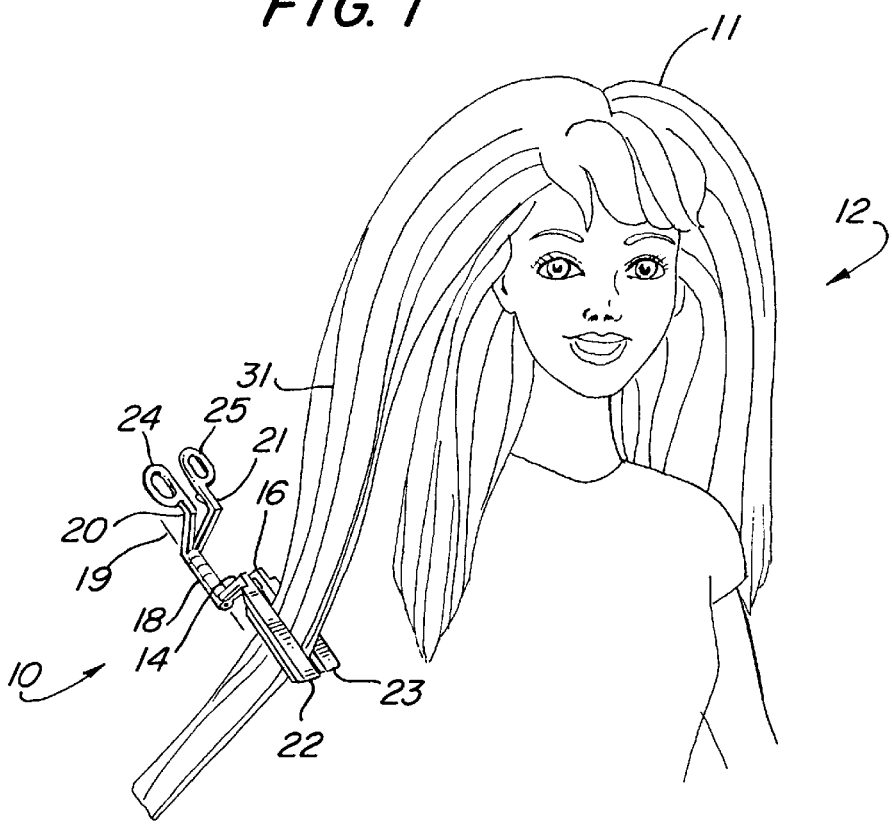
FIG. 1 is a perspective view of the instrument being used to cut hair.

A haircutting instrument 10 of the instant invention is used in cutting the hair 11 of a person 12 as shown in the example of FIG. 1. The haircutting instrument 10 has first and second members 14,16 pivotally connected together by a hinge 18 having an axis 19. The members 14,16 have arms 20, 21 and legs 22, 23. The arms 20, 21 are separated from the legs 22, 23 of the members 14, 16 by a hinge portion, respectively.

Figure 2:
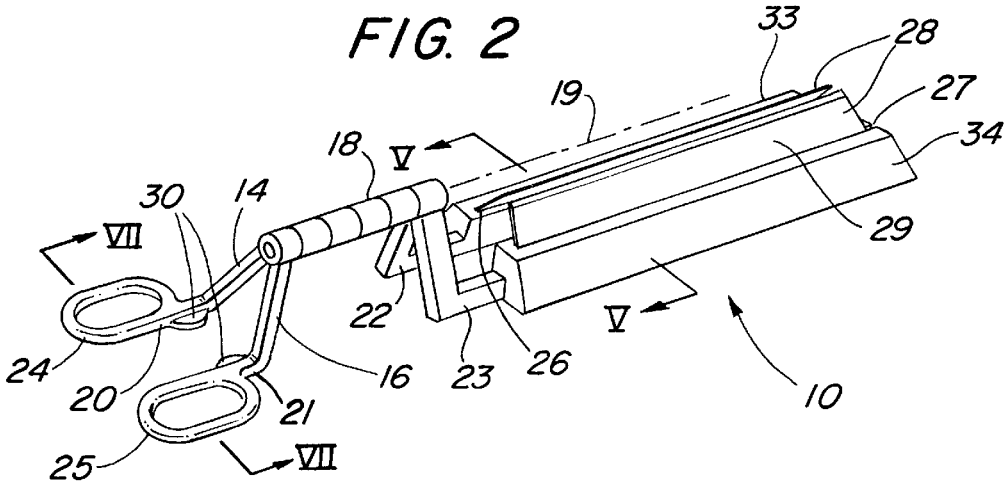
FIG. 2 is a perspective view of the instrument.

As shown in FIG. 2, the hinge 18 pivotally couples the first and second members 14, 16 together in a non-crossing configuration. Each of the two members 14, 16 remains on its own side of the hinge axis 19 during operation of the hinge 18. The arms 20, 21 have respective grip portions 24, 25 and the legs 22, 23 have respective sockets for receiving a razor blade 29 or other tool 28.

FIG. 2 shows an important aspect of the invention. This aspect is related to the orientation and position of the hinge 18. The hinge 18 has its axis 19 generally aligned with a length of the instrument 10. The important aspect shown in FIG. 2 is that the grip portions 24, 25 of the members 14, 16, respectively are offset from the hinge axis 19. The legs 22, 23 are also offset from the hinge access. The difference between the offsets of the grip portions 24, 25 and the legs 22, 23 determines the amount of mechanical advantage that is afforded to the user when using the instrument 10.

Another important aspect of the present invention is that the two members 14, 16 each extend lengthwise in a longitudinal direction. Each of legs 22, 23 and arms 20, 21 have straight features which extend lengthwise in the longitudinal direction. These straight features are generally parallel to each other and to the hinge axis 19 so that they remain parallel to each other and parallel to the hinge axis 19 during the operation of the hinge 18. As such, these straight features comprise pairs of straight features on respective members 14, 16. These pairs of straight features are disposed to sweep out respective circumferential arcs of common circles that are concentric with the hinge axis 19.

As best illustrated in FIGS. 1–2 and 7, the arms 20, 21 have the straight features referred to above provided by portions of the arms that extend in the same direction as the hinge axis 19 between generally radially extending portions of the arms 20, 21 and the grip portions 24, 25, respectively.

The figures show the first leg extending along a first line and the second leg extending along a second line. These lines are clearly parallel to each other. The embodiment of FIGS. 1 and 2 has arms 20, 21 with generally straight features extending in the same directions as the first and second lines. In fact, the straight features of the first and second arms 20, 21 may extend along the first and second lines defined by the first and second legs 22, 23. Alternatively, they may be offset from the first and second lines. In either case, the first and second lines are spaced from a third line defined by the hinge axis 19 of hinge 18.

It can be seen from FIG. 2 that the portions of the arms 20, 21 that extend radially away from the hinge axis 19 may serve as stops to define one end of the range of motion of the members 14, 16 with respect to each other. In this case, no additional structure is required. Alternatively, stops 30 may be provided in order to determine an end of a range of motion of the members 14, 16 relative to the each other in a closed, pinching or clamping configuration. It can be seen that in the pinching or clamping configuration that legs 22, 23 remain spaced apart such that a lock of hair 31 is permitted to slide between legs 22, 23. On the other hand, tools 28 abut each other and will pinch and cut individual hairs 32 of the lock of hair 31 when the instrument 10 is clamped thereon and pulled in a direction along the length of the lock of hair 31.

Figure 3:
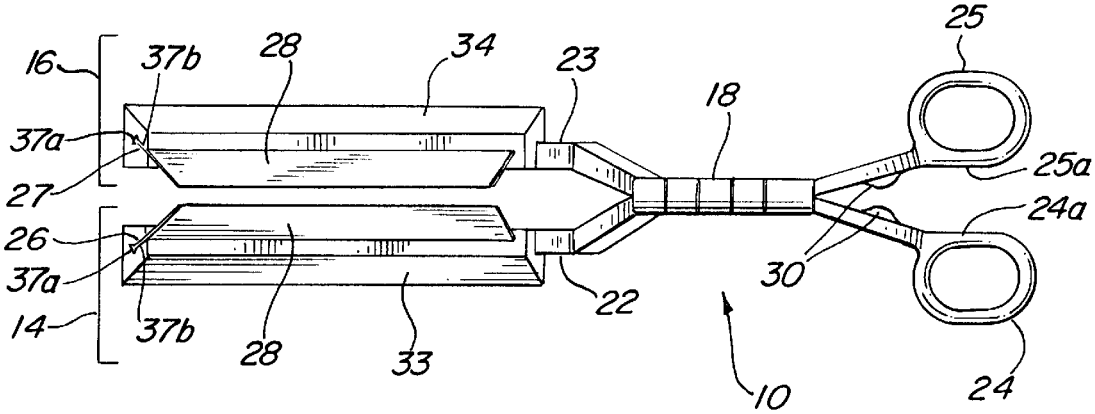
FIG. 3 is a top plan view of the instrument.

FIG. 3 clearly shows that the tools 28 not only approach each other in pinching or clamping configuration, but that they also approach each other in a parallel relationship. The legs 22, 23 also have respective jaws 33, 34 that remain parallel to each other during operation of the hinge 18. When the jaws 33, 34 approach each other toward a clamping configuration, the opposing tools 28 eventually meet each other in parallel abutting relationship. This permits the lock of hair 31 to be pinched or clamped between the tools 28 for cutting action.

Figure 4:
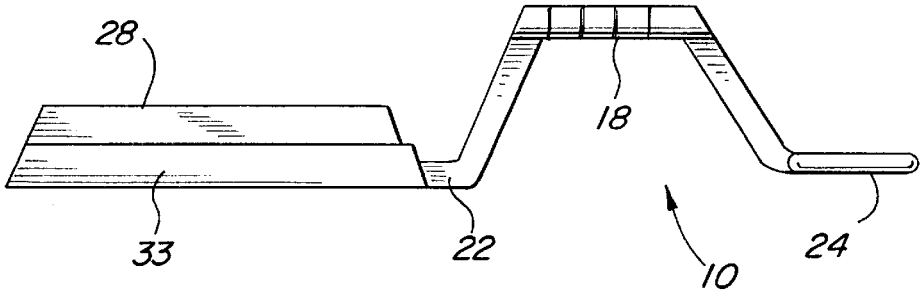
FIG. 4 is a side elevation view of the instrument.

The embodiment of FIGS. 3 and 4 is substantially similar to the embodiment of FIGS. 1 and 2 with the exception of the arms. FIGS. 3 and 4 have substantially no axially extending portion on their alternative arms 35, 36 between the radially extending portions and the grip portions. However, portions of the grip portions of alternative arms 35, 36 extend along lines parallel to or aligned with the lines defined by the straight features of the legs 22, 23. Furthermore, portions 24*a*, 25*a* of the grip portions 24, 25 extending along lines parallel to or aligned with lines defined by the straight features of the legs can be considered as providing straight features themselves. Certainly, it is within the spirit and scope of the invention to construct these portions such that they have straight features.

FIG. 4 is a side view that further shows the offsets of the grip portions 24, 25 and the legs 22, 23 from the hinge axis 19.

Figure 5:
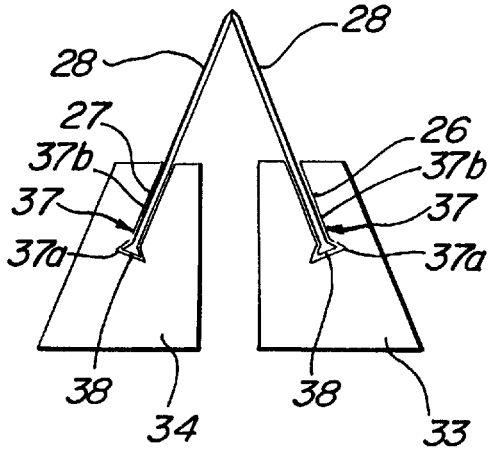
FIG. 5 is a cross section view taken along lines V—V of FIG. 2.

FIG. 5 is a section view taken along lines V—V of FIG. 2 and showing the jaws 33, 34 and their respective sockets 26, 27. The sockets 26, 27 may be of any configuration, but are illustrated in the form of grooves 37. Preferably the grooves 37 have an enlarged or reentrant base portion for receiving an enlarged portion 38 of the tool 28. The enlarged base portion of the grooves 37 and the enlarged portion 38 of the tool 28 may be of any shape or configuration as long as they mate when the tool 28 is in a respective groove 37. It is of particular interest to provide the enlarged portion 38 of the tool 28 larger than the non-enlarged portion of the groove 37 into which the tool 28 is inserted. In this way the tool 28 is prevented from leaving the groove in a generally radial direction along the groove. The directions that the tools 28 may be inserted and removed from the sockets 26, 27 are axial directions.

The tools 28 that can be received in sockets 26, 27 are selected from the group comprising razor blades 29, knives, thinning tools 40, and back guards 41. FIG. 5A is a detailed top view of a cut away portion of tools similar to FIG. 3, showing thinning tool 40 with edges 42. These thinning tool edges 42 can be notched or comb shaped as illustrated in FIG. 5A.

Figure 5B:
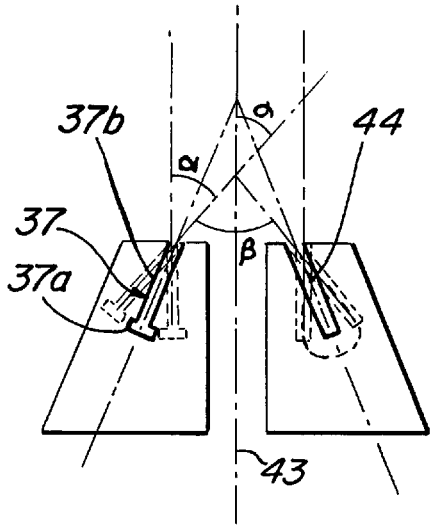
FIG. 5B is a cross section view similar to FIG. 5 showing the range of angles at which the sockets can be disposed.
Figure 5A:
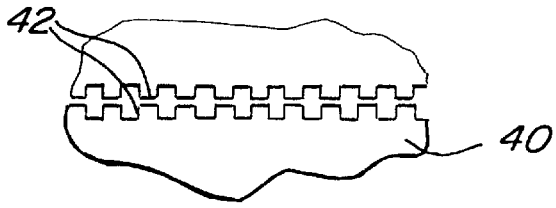
FIG. 5A is a detailed top view of a cut away portion of tools similar to FIG. 3 showing alternative tools edges.

FIG. 5B shows that the instrument 10 can be made to accommodate tools 28 which are oriented at an angle measured relative to a plane 43 bisecting the instrument 10. By way of example, this angle may be included within a range of 0 to 45 degrees when the instrument 10 is in a closed, pinching or clamping configuration. Expressed in another way, the instrument 10 can be constructed so that the angle between the tools 28 can vary in a range of 0 to 90 degrees. It should also be noted from FIG. 5B that the socket 45 may be of a modified form in order to receive a back guard 41, which will typically be formed of a rigid material such as plastic.

Figure 6:
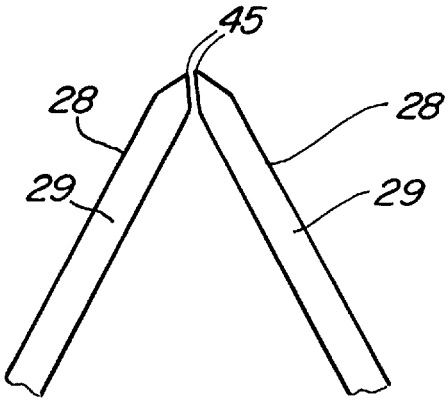
FIG. 6 is a detailed end view of section VI of FIG. 5 showing how the tools meet at distal edges.

FIG. 6 is a detailed end view of portion VI of FIG. 5 and shows how the tools 28 abut each other. As is shown, the distal edge 45 of each tool 28 meets a distal edge 45 of the other tool 28 in mutually abutting relationship.

Figure 6A:
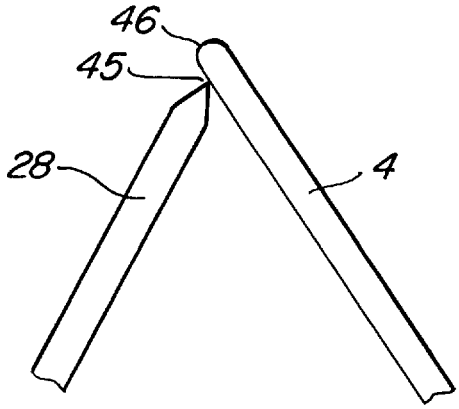
FIG. 6A is a detailed end view similar to FIG. 6, but showing the razor blade and a back guard tool combination meeting at their distal edges.

FIG. 6A shows a detailed end view similar to FIG. 6 having the combination of a blade and a back guard 41 in respective jaws 33, 34. With this combination the tips of the tools 28 will typically meet at their edges 45, 46. The distal edge 46 of the back guard 41 should extend at least to a distal edge 45 of the razor blade 29 or beyond. Conceptually, the two razor blade configuration of FIG. 6 is similar to the configuration of FIG. 6A wherein one of the razor blades 29 in FIG. 6 serves as a back guard 41.

FIG. 7 is a sectional view taken along lines VII—VII of FIG. 2. This view emphasizes the possibility of selectively forming the arms 20, 21 in other than a planar configuration. Specifically, the arms 20, 21 may include grip portions 24, 25 or finger loops having grip portions 24, 25 defining planes at plus or minus 70 degrees from the flat plane defined by finger loops of a regular pair of scissors. Expressed another way, each of the finger loops may define a plane that is between 20 and 160 degrees relative to a bisecting plane that symmetrically bisects the two members 14, 16 of the instrument 10 when in its closed, pinching or clamping configuration.

FIG. 7A is a detailed view of the portion of FIG. 3 encircled by the line VIIa. FIG. 7A shows the selectively variable way in which the alternative arms 35, 36 may be configured. Specifically, the alternative arms 35, 36 may be formed to define any of a variety of angles therebetween in order to meet the needs of a variety of users. It is of particular interest to locate the grip portions 24, 25 at a distance that permits the user to apply a force with ease. Locating the grip portions 24, 25 at the right distance is important for hairdressers or barbers who spend long hours utilizing instruments that they must grip. FIGS. 3 and 7A also show a variation from the embodiment shown in FIG. 2 in that the additional stops 30 are located along the portions of the alternative arms 35, 36 that extend radially away from the hinge 18.

FIG. 7B shows an alternative embodiment of the grip portions 24, 25 in the form of finger loops 47, 48. As shown by the dashed lines in FIG. 7B the grip portions may be formed by finger loops 47 which extends inwardly or by finger loops 48 which extend outwardly from the remaining part of the arms. The finger loops 47, 48 may be selectively spaced similarly to the embodiment of FIG. 7A.

Figure 8A:
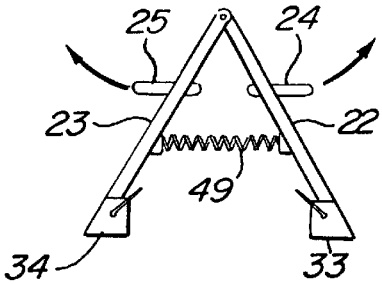
FIGS. 8A and 8B are end views showing alternative embodiments including tension and compression springs, respectively.
Figure 8B:
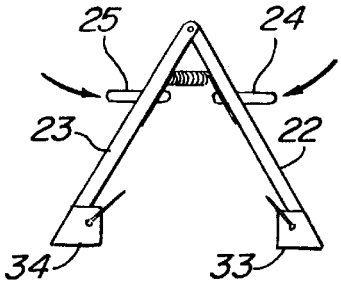

FIGS. 8A and 8B are end views of the instrument 10 showing alternate embodiments which include springs 49, 50. FIG. 8A shows a tension spring 49 that will hold the two members 14,16 of the instrument 10 together in a clamping configuration. In this embodiment the user is required to force the jaws open by moving his or her fingers outwardly to expand the jaws against the bias of tension spring 49. FIG. 8B, on the other hand, has a compression spring 50 that applies an outward force to the members 14, 16. In this embodiment, a user is required to force the members 14, 16 inwardly together by squeezing the grip portions 24, 25 against the bias of spring 50.

Figure 8C:
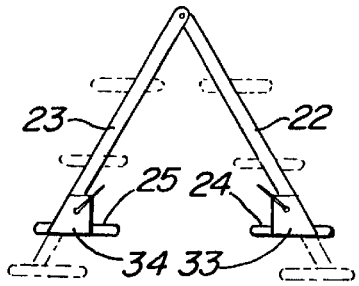
FIG. 8C is an end view showing selectively alternative embodiments locating finger loops at varying distances from the hinge axis.

FIG. 8C is an end view showing alternative locations of the grip portions 24, 25 in dashed lines. By selecting the distance of the grip portions 24, 25 from the axis 19 of the hinge 18, the mechanical advantage is determined. It can be seen that if the grip portions 24, 25 are further away from the hinge axis 19 than are the distal edges 45 of the tools 28, a relatively small force applied to the grip portions 24, 25 will result in a larger force at the distal edges 45 of the tools 28 for pinching and cutting the lock of hair 31.

Figure 9:
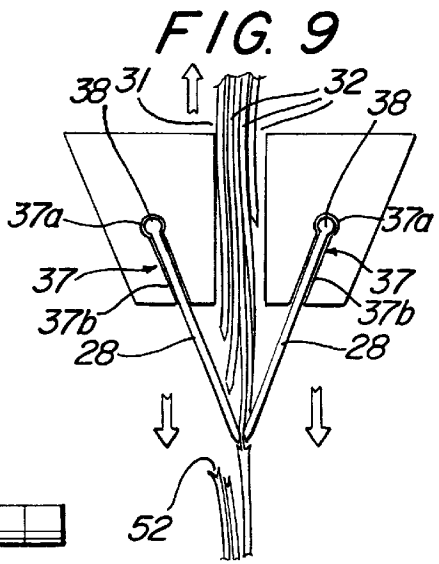
FIG. 9 is a cross section view similar to FIG. 5 depicting the actual cutting during use of the instrument.

FIG. 9 shows the effect of clamping the tools 28 on a lock of hair 31 and pulling the instrument 10 in the direction of the large arrows. As can be seen by the half-diamond shape 52 of the cut ends of the individual hairs 32 in FIG. 9, both tools 28 act in a cutting function. By constructing the instrument so that the angles of the tools 28 are proper and by properly selecting blades having an angle of the taper of the cutting edges 45, cutting a lock of hair 31 actually causes a slight inward force on the tools 28 and in turn on the jaws 33, 34 of the instrument 10 such that little or no clamping force is required during the pulling or pushing force along the length of the lock of hair 31. Expressed in another way, when the tools 28 comprise two razor blades 29 with edges 45 having tapers which extend inwardly and away from the instrument 10, a plowing effect pushes the tools 28 and thus the jaws 33, 34 together when the instrument 10 is moved along the lock of hair 31 in a cutting action. The half-diamond shape 52 of the cut ends will only occur when a given individual hair 32 is cut by both blades. Most hairs 32 of a lock 31 will normally be protected on one side by other hairs 32 of the lock 31 and will only be cut by one blade.

Figure 9A:
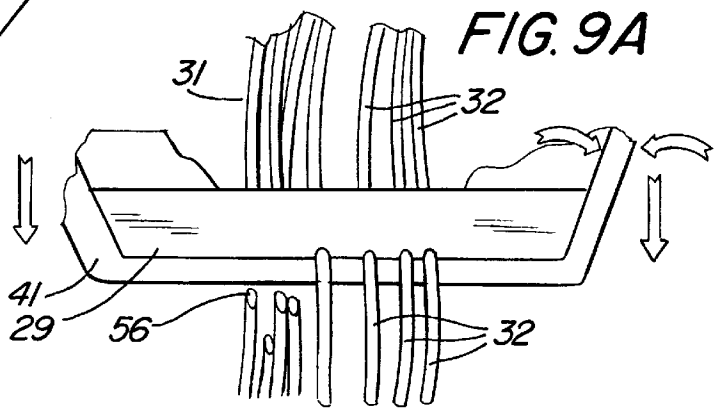
FIG. 9A is a side elevation view of the cutting process similar to that shown in FIG. 9.

FIG. 9A shows a cutting action with the instrument 10 having a razor blade 29 for one of its tools 28 and a back guard 41 for the other of its tools 28. In this embodiment the individual hairs 32 are cut to have a single flat severed surface 56. Because of the angle of the razor blade 29 this single flat surface 58 forms an acute angle with respect to a lengthwise direction of the lock of hair 31 and the individual hairs 32 of the lock 31.

Figure 10:
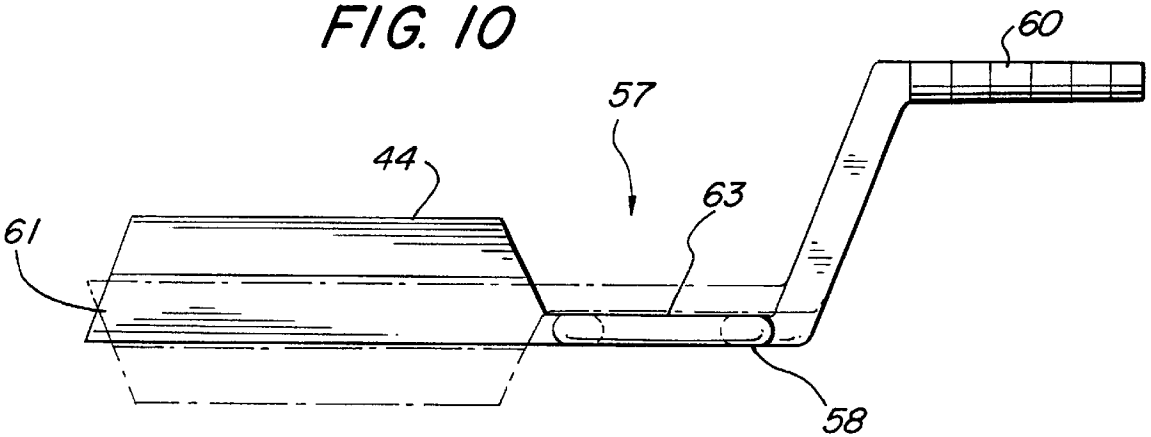
FIGS. 10 and 11 are side elevation views showing alternative embodiments of the instrument of the present invention.

FIG. 10 is an alternative embodiment showing a haircutting instrument 57 in which arms 58 have been relocated to a position between hinge 60 and legs 61. In this embodiment a user would position the hinge 60 in the palm of the hand or extending away from the palm of the hand with the fingers located in grip portions of the arms 58. As can be seen by the dashed lines, the sockets 26, 27 and the tools 28 may be oriented such that the distal cutting edges 45 of the tools 28 may point in the same direction as the hinge 60 or away from the hinge 60.

Figure 11:
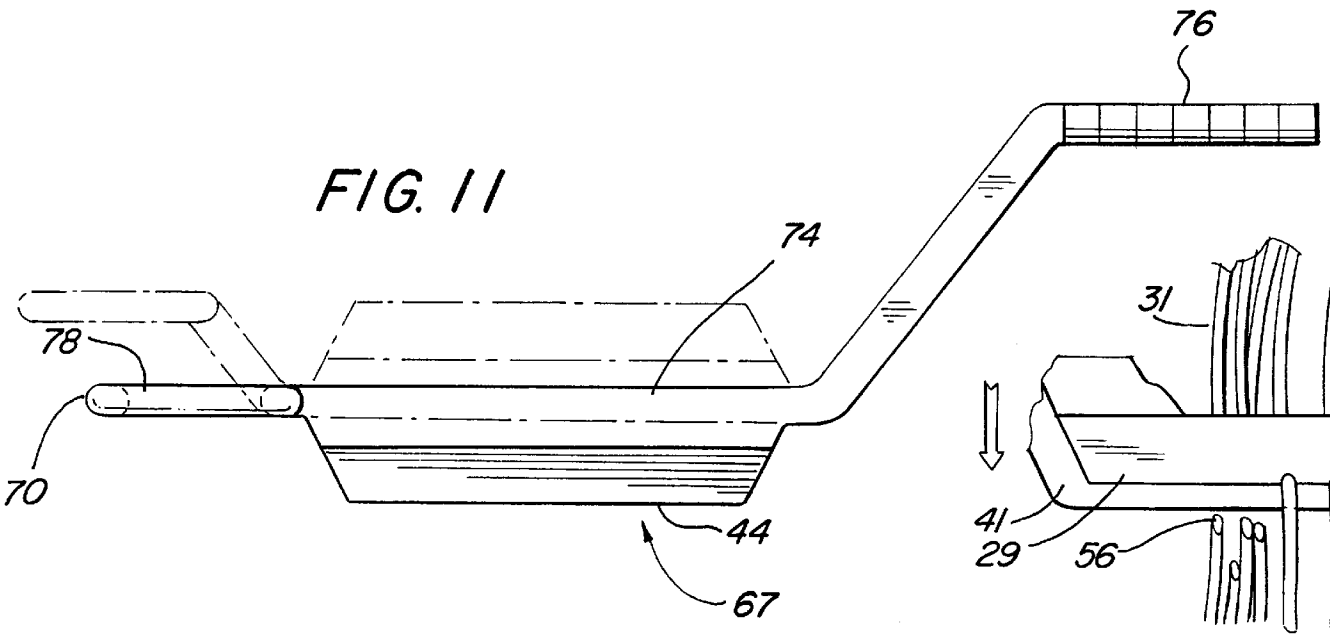

FIG. 11 is a further alternative embodiment showing a haircutting instrument 67 in which the arms 70 of the instrument 67 are located on an opposite end of the legs 74 from the hinge 76. In this embodiment it is contemplated that two hands would be used to pull or push the instrument 67 along the length of the lock of hair 31. As can be seen by the dashed lines, the arms 70 comprising grip portions 78 may be located at the same distance from the axis of the hinge 76 or alternatively may be placed at a location closer to the axis of the hinge 76. In this embodiment, similar to the embodiment of FIG. 10, the sockets 26, 27 and tools 28 can be made to face toward the axis of the hinge 76 or away from the axis of the hinge 76.

The method of using the haircutting instrument 10 of the instant invention is accomplished by a user cutting the hair 11 of a person 12 18. The method results in a tapered cut, or a thinned and tapered cut. In accordance with this method, the user separates the legs 22, 23 of the instrument 10 by moving the arms 20, 21 in a first direction. Then the user places a lock of hair 31 between the legs 22, 23. The user then clamps the legs 22, 23 on the lock of hair 31 by moving the arms 20, 21 in second direction. Then the user simultaneously maintains a clamping force on the lock of hair 31 and forces the instrument 10 in a direction generally perpendicular to the cutting edge 45. This action severs individual hairs 32 of the lock by a clamping and pulling action. This method requires the placement of the instrument 10 with the tools 28 oriented transverse to the lock of hair 31. Preferably the orientation of the instrument 10 is between 45 degrees and 135 degrees relative to the lock of hair 31. In the preferred embodiment a longitudinal axis 19 of the instrument 10 coincides with the longitudinal extension of the blade edges 45 on the tool 28. However it is contemplated that an instrument may be formed within the spirit and scope of this invention, which has an axis 19 which is longitudinal in a direction other than transverse to the blade edges 45.

Another aspect of the preferred embodiment is that in the method of using the instrument 10 an inward force on the jaws 33, 34 is maintained by virtue of the angle of the tapers on the blades disposed in the sockets 26, 27 in a clamping or pinching configuration. This inward force is caused by the shape of the blade tapers and the force of the instrument 10 moving in a direction along the length of the lock of hair 31, wherein a plowing effect is achieved which causes the inward force on the blades and thus on the jaws 23 of the instrument 10.

The method of using further comprises a preliminary step of selecting the tools 28 from a group of tools. The group of tools comprises a razor 29, a knife, a thinning tool 40 and a back guard 41. In the present invention the terms razor and knife are used interchangeably. However, it is understood that a knife generally has a thicker blade and often is not of the disposable type, which are more commonly termed razor blades. The preliminary step of selecting the tools 28 and fitting them in the sockets 26, 27 may comprise selectively choosing either two razor blades 29, a razor blade 29 and a back guard 41, two thinning blades, or a thinning blade and a back guard 41. Any combination of the tools 28 may be selected as long as one of the tools 28 selected has a blade for cutting hair 11.

While the method of using the haircutting instrument has been described relative to the embodiment of FIGS. 1–2 and 7, it should be well understood that the method of use will typically apply equally to all of the embodiments. Analogous parts are readily apparent from one embodiment to another in applying the method of use.

There may be other embodiments and variations of embodiments that are not set forth here, and which are within the spirit and scope of the instant invention. Furthermore, the instant invention is not to be limited by the description and terms used herein, but is only to be limited in accordance with the claims.

I claim:

1. A haircutting instrument, comprising:

two members, each of said two members having an arm and a leg extending generally lengthwise in a longitudinal direction;

said members being pivotally coupled together by a hinge, said hinge having an axis generally parallel to said longitudinal direction;

said legs having at least one socket adapted to removably receive at least one tool;

wherein each leg has at least one straight feature, said straight features being continuously parallel to each other and selectively moveable toward and away from each other by operation of the hinge.

2. The haircutting instrument of claim 1, wherein said straight features are generally parallel to the axis of the hinge when the legs are in a first closed, pinching configuration and in a second open configuration.

3. The haircutting instrument of claim 1, wherein the tool includes at least one of a razor blade, a knife, a thinning blade, and a back guard.

4. The haircutting instrument of claim 3, wherein the at least one socket is a first socket, said legs having a second socket, the first and second sockets disposed in respective legs, said sockets adapted to removably receive a first razor blade and a back guard.

5. The haircutting instrument of claim 4, wherein:

said back guard is a second razor blade; and the sockets are configured to present a cutting edge of said second razor blade in a generally parallel relationship to the cutting edge of said first razor blade.

6. The haircutting instrument of claim 5, wherein the sockets are adapted to present the cutting edges to abut each other in the pinching configuration such that the first and second razor blades define planes that are between 0 and 90 degrees relative to each other.

7. A haircutting instrument comprising:

two members, each member having an arm and a leg, said members pivotally coupled together by a hinge having an axis, said members pivotally coupled in a non-crossing configuration such that the arm and the leg of each member are on a common side of the axis, said arms having respective grip portions for manual manipulation, said legs having respective jaws and a tool removably carried by at least one of the jaws for clamping a lock of hair between the tool and the other of the jaws in a clamping position.

8. The haircutting instrument of claim 7, wherein:

said jaws are adapted to move along a common arc generally centered on the axis of the hinge during hinging movement; and said jaws are disposed in a continuously parallel relationship to each other and to the axis of the hinge during hinging movement.

9. The haircutting instrument of claim 7, wherein each arm is separated from each leg of each member by said hinge.

10. The haircutting instrument of claim 7, wherein each grip portion and each tool is offset from the hinge axis, wherein an offset of the grip portions is at a first radial distance from the hinge axis and an offset of the tool is at a second radial distance from the hinge axis, and wherein the amount of mechanical advantage achieved by the instrument depends on the relative distances of said offsets from said hinge axis.

11. The haircutting instrument of claim 7, wherein:

the two members generally define opposite sides of the instrument bounded by a bisecting plane through the axis;

the respective jaws each have a groove with an enlarged base portion;

the enlarged base portion of the groove receives an enlarged base portion of said tool; and the grooves are oriented such that the tool is disposed in a plane having an angle between 0 and 15 degrees relative to the bisecting plane when the instrument is in the clamping position.

12. The haircutting tool of claim 11, wherein:

the arm portions comprise finger loops for grasping the instrument; and the finger loops are disposed generally in planes that are between 20 and 130 degrees relative to the bisecting plane.

13. The haircutting tool of claim 7, said arms further comprising:

a respective stop on each arm; and the stops abutting each other in the clamping position, thereby holding the legs in spaced relation to enable a lock of hair to slide between the legs during use of the instrument.

14. A method of using a haircutting instrument having a first member and a second member hinged to each other, each member having an arm and a leg, said instrument having at least one cutting edge on one of the legs, the method comprising the steps of:

separating the legs by moving the arms in a first direction;

placing a lock of hair between the legs;

clamping the legs on the lock of hair by moving the arms in a second direction;

maintaining a clamping force on the lock of hair;

during the maintaining step, moving the instrument in a direction generally transverse to the cutting edge to sever hairs of the lock by said clamping and moving action.

15. The method of claim 14, wherein the members are generally elongate and wherein the moving of the instrument further comprises:

orienting a longitudinal axis of the instrument in a direction between 15 and 135 degrees relative to the lock of hair.

16. The method of claim 14, wherein:

the step of moving the instrument facilitates maintaining the clamping force on the lock of hair.

17. The method of claim 14, wherein the legs comprise jaws having sockets, and further comprising a preliminary step of selectively disposing at least one tool in the sockets, the tool being selected from the group comprising a razor, a knife, a thinning tool, and a back guard.

18. The method of claim 17, wherein the legs comprise jaws having respective said sockets, and further comprising a preliminary step of selectively disposing at least one tool from said group in each of the sockets, and wherein the step of clamping the legs comprises clamping the lock of hair between a razor and a back guard.

19. The method of claim 17, wherein the legs comprise jaws having respective said sockets, and further comprising a preliminary step of selectively disposing at least one tool from said group in each of the sockets, and wherein the step of clamping the legs comprises clamping the lock of hair between two razors.

20. The method of claim 17, wherein the legs comprise jaws having respective said sockets, and further comprising a preliminary step of selectively disposing at least one tool from said group in each of the sockets, and wherein the step of clamping the legs comprises clamping the lock of hair between two thinning tools.

21. A method of using a haircutting instrument having a first member and a second member hinged to each other, each member having an arm and a leg, and at least one of the legs comprising a jaw with a socket said instrument having at least one cutting edge on one of the legs, the method comprising the steps of:

selectively disposing at least one tool in the socket, the tool being selected from a group comprising a razor, a knife, a thinning tool, and a back guard;

separating the legs by moving the arms in a first direction;

placing a lock of hair between the legs;

clamping the legs on the lock of hair by moving the arms in a second direction;

maintaining a clamping force on the lock of hair; and during the maintaining step, moving the instrument in a direction generally transverse to the cutting edge to sever hairs of the lock by said clamping and moving action.

* * * * *